US006968750B2

(12) United States Patent
Wilson

(10) Patent No.: US 6,968,750 B2
(45) Date of Patent: Nov. 29, 2005

(54) ROD SAMPLING

(75) Inventor: Ronald Frederick Wilson, Buckingham (GB)

(73) Assignee: Molins, plc, Milton Keynes (GB)

( * ) Notice: Subject to any disclaimer, the term of this patent is extended or adjusted under 35 U.S.C. 154(b) by 72 days.

(21) Appl. No.: 10/296,644

(22) PCT Filed: Jun. 1, 2001

(86) PCT No.: PCT/GB01/02436

§ 371 (c)(1),
(2), (4) Date: May 5, 2003

(87) PCT Pub. No.: WO01/93706

PCT Pub. Date: Dec. 13, 2001

(65) Prior Publication Data

US 2003/0167860 A1 Sep. 11, 2003

(30) Foreign Application Priority Data

Jun. 2, 2000 (GB) ..... 0013527

(51) Int. Cl.[7] ..... G01N 1/08; G01N 1/20; A24C 5/34

(52) U.S. Cl. ..... 73/863.51; 73/863.91

(58) Field of Search ..... 73/863.51–863.56, 73/863.91, 863.92

(56) References Cited

U.S. PATENT DOCUMENTS 4,024,765 A * 5/1977 Abonnenc ..... 73/863.83
4,962,771 A * 10/1990 Neri et al. ..... 73/863.91 X
5,154,087 A * 10/1992 Wenshau et al. ..... 73/863.85

FOREIGN PATENT DOCUMENTS

| | | |
|---|---|---|
| DE | 34 19 659 C1 | 9/1985 |
| FR | 2 566 238 A1 | 12/1985 |
| GB | 2 068 870 A | 8/1981 |
| GB | 2 203 626 A | 10/1988 |
| GB | 2 241 865 A | 9/1991 |

* cited by examiner

*Primary Examiner*—Thomas P. Noland
(74) *Attorney, Agent, or Firm*—Caesar, Rivise, Bernstein, Cohen & Pokotilow, Ltd.

(57) ABSTRACT

A probe for use in sampling rods from a mass flow of parallel rods moving perpendicular to their axes, the probe including an elongate body of generally wedge shaped cross section which has first and second main faces diverging away from a narrow edge to a wider base and which is for mounting parallel to such rods to extend across and laterally beyond such mass flow with the narrow edge facing upstream; an elongate passage extending within the body longitudinally thereof for accommodating a rod from such mass flow; a first elongate opening in the first face through which a rod from such mass flow can fall laterally into the passage for longitudinal transport along the passage away from such mass flow; and a second elongate opening through which a rod can drop laterally from the passage out of the body after such longitudinal transport.

27 Claims, 7 Drawing Sheets

FIGURE 1
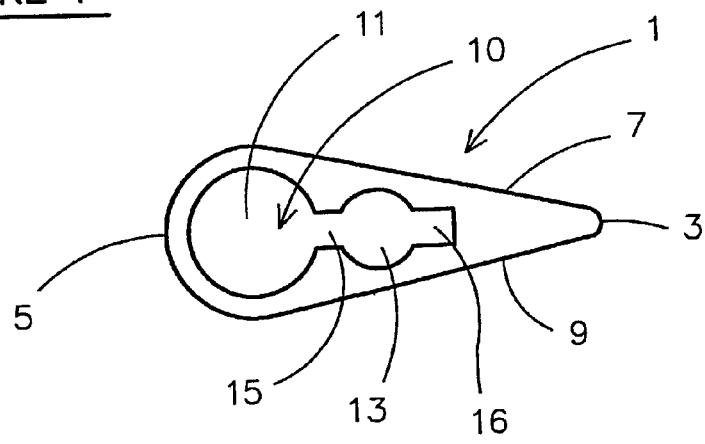
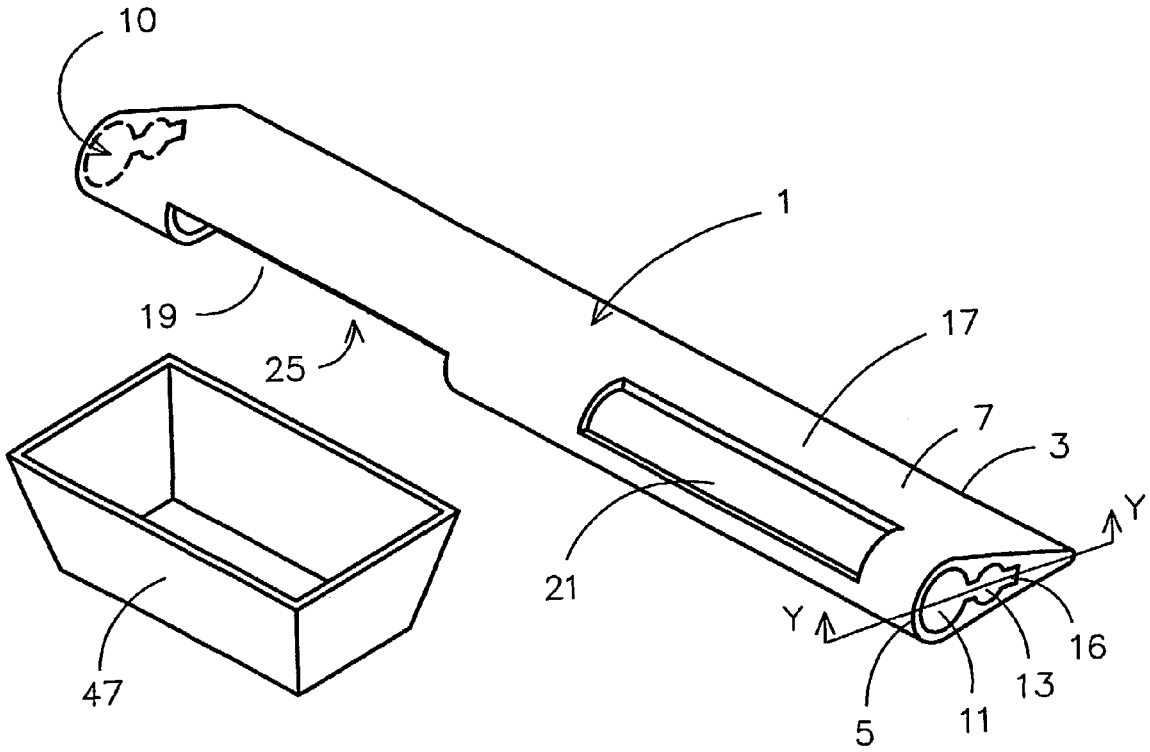
FIGURE 2

ROD SAMPLING

BACKGROUND OF THE INVENTION

The present invention relates to rod sampling, and provides a method and apparatus for sampling rods including cigarettes, filter cigarettes and filter rods.

When manufacturing cigarettes and cigarette filter rods it is important that random samples are tested for the required quality and performance, for example weight, pressure drop, size etc. The samples may be removed during manufacture from a production line, e.g. from a mass flow, and transported to a test site without interrupting the manufacturing process. Any variation of the samples from a sufficient standard of quality and performance may be due to a problem in the manufacturing process, requiring adjustment or even termination of the process. Cigarettes and cigarette filter rod products are manufactured at a rate of several hundred per second; it is important that any problem is recognised (and solved) quickly in order to avoid manufacture of large numbers of inferior products (which must then be discarded).

SUMMARY OF THE INVENTION

According to the present invention there is provided a probe for use in sampling rods from a mass flow of parallel rods moving perpendicular to their axes, the probe comprising:

an elongate body of generally wedge shaped cross section which has first and second main faces diverging away from a narrow edge to a wider base and which is for mounting parallel to such rods to extend across and laterally beyond such mass flow with the narrow edge facing upstream; an elongate passage extending within said body longitudinally thereof for accommodating a rod from such mass flow; a first elongate opening in the first face through which a rod from such mass flow can fall laterally into said passage for longitudinal transport along said passage away from such mass flow; and a second elongate opening through which a rod can drop laterally from said passage out of said body after such longitudinal transport.

In another aspect the invention provides a rod sampler comprising a probe as defined above and means for transporting a sample rod accommodated in the passage longitudinally therealong for exit from the probe through said second elongate opening.

The invention can provide a probe with no exposed moving parts thus reducing the possibility of jamming or trapping a sample rod.

In a further aspect the present invention provides a method of sampling rods for testing from a mass flow of parallel rods moving perpendicular to their axes, the method comprising collecting a rod in an elongate sampler probe extending parallel to the rods across and beyond the mass flow, conveying the collected rod longitudinally through the probe to a position adjacent to the mass flow and there delivering the conveyed rod into a receiver, repeating such collection, conveying and delivery to provide a plurality of parallel rods in the receiver, moving the receiver with the aligned rods therein to a test site along a guide path such that the rods come into registration under gravity, and transferring the registered rods from the receiver to the test site, said collection, conveying and delivery being conducted without application of pneumatic pressure directly onto said rods and substantially without impact on said rods.

According to the invention in a further aspect there is provided a method of sampling rods for testing from a mass flow of parallel rods moving perpendicular to their axes, the method comprising collecting an individual rod in an elongate sampler probe extending parallel to the rods across and beyond the mass flow, conveying the collected rod longitudinally through the probe to a position adjacent to the mass flow and there delivering the conveyed rod directly to a test site, and repeating such collection, conveying and delivery, said collection, conveying and delivery being conducted without application of pneumatic pressure directly onto said rods and substantially without impact on said rods.

According to the invention in a further aspect there is provided rod handling apparatus comprising a conveyor for carrying a mass flow of parallel rods perpendicular to their axes, a ramp down which rods are fed perpendicular to their axes to the conveyor, an elongate sampling probe extending across the flow path and having in its upper face an elongate opening for the collection in the probe of a rod from the mass flow, and means for transporting such a collected rod longitudinally through the probe away from the mass flow, the probe being positioned at or adjacent to the ramp and being of generally wedge shape with the wedge apex facing upstream whereby the probe causes little disturbance to the mass flow.

According to the invention in a further aspect there is provided apparatus for sampling rods from a mass flow of the rods perpendicular to their axes, the apparatus comprising an elongate probe which is for extending across such mass flow parallel to such rod axes and which has a passage extending longitudinally thereof for transport of a sampled rod and an elongate window through which a sample rod can pass from such mass flow into said passage, means operable to transport a rod received through said window longitudinally through said passage away from said window to an exit and to reset the apparatus for receipt of another rod from such mass flow through the window into the passage, and blocking means which simultaneously with said transport moves along the passage into registration with the window and which remains in such registration until said resetting.

Preferably the methods and apparatus according to the invention utilise probes and samplers according to the invention.

Embodiments of the invention may provide reduced or no disturbance to the mass flow.

Embodiments of the invention avoid the problems caused by pneumatic sampling systems which apply air directly to the sample thereby causing damage (damage to sample ends caused by collisions; tobacco loss etc.). Embodiments of the invention may provide a probe which takes a sample from mass flow and drop it directly into a receiver. The receiver may be a test machine, or the sample or samples may be transported directly to a test site within the receiver.

In a further embodiment the invention can provide an apparatus for sampling rods from a mass flow on the exit ramp of a manufacturing machine.

The probe and rod sampler according to the invention allows for removal of samples from mass flow for transport to a test site for testing as quickly as possible, to thereby decrease the response time, that is the time between recognition of a fault in the process and rectification of the fault. The exit ramp of the manufacturing machine is one of the earliest points where completed products are available for sampling; before this point there is a risk that the adhesive used in manufacture will not be cured causing erroneous test results.

BRIEF DESCRIPTION OF THE DRAWINGS

Embodiments of the present invention will now be described by way of example with reference to the accompanying drawings in which:

FIG. 1 is a cross section of a probe according to the present invention;

FIG. 2 is a view of the probe of FIG. 1 from the top and to one side, showing elements that are obscured from the top in dotted outline;

DETAILED DESCRIPTION OF THE INVENTION

Figure 3:
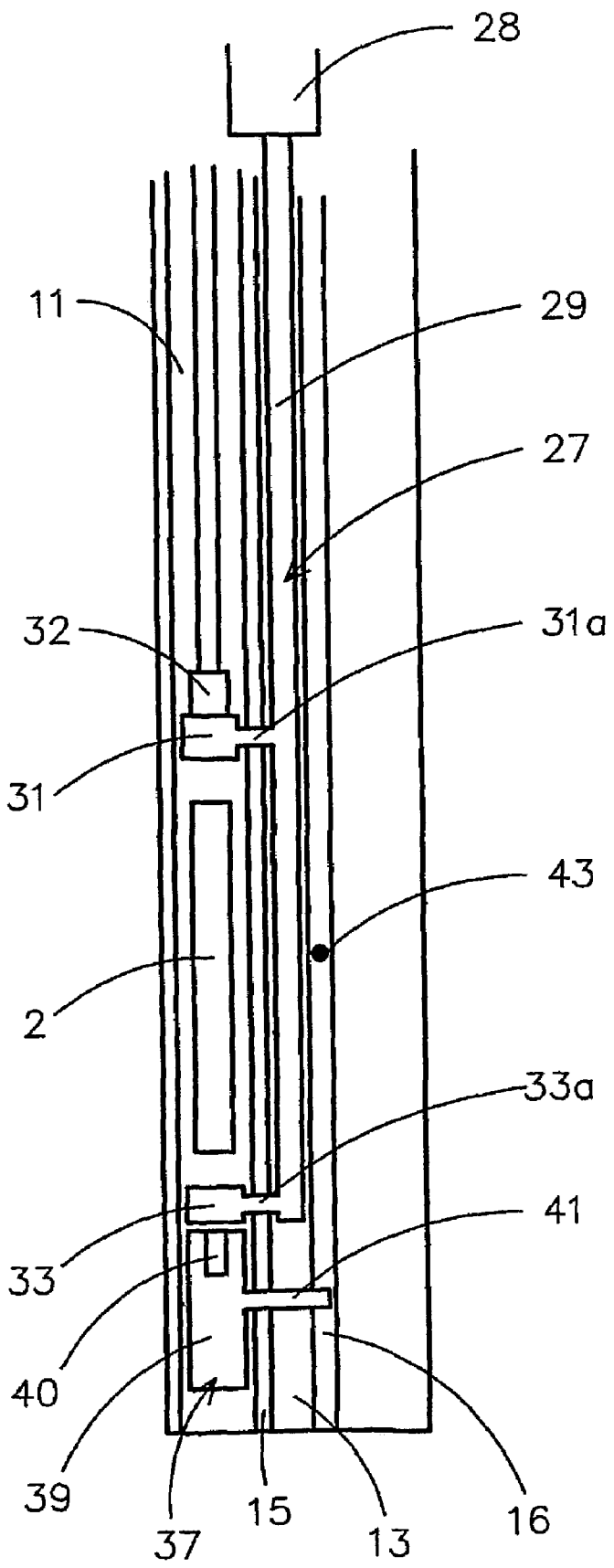
FIG. 3 is a longitudinal cross section of a rod sampler, incorporating the probe of FIGS. 1 and 2, taken along a line equivalent to line Y—Y of FIG. 2.

The probe of FIGS. 1 and 2 has a unitary streamlined probe body 1, preferably formed by a unitary extrusion.

The probe body is generally wedge shaped in cross section, and has top face 7 and bottom face 9, which are angled to each other to form the wedge shape. These two main faces diverge at an angle of significantly less than 45°, preferably 30° or less, e.g. 20 to 30°; in the illustrated embodiment the divergence is about 25°. Faces 7 and 9 diverge from a common edge, which forms the apex or narrow end 3 of the wedge shape, to a wider base 5. In this embodiment the apex 3 is rounded. The wider base 5 may also be rounded, and in the illustrated case is substantially semicylindrical.

The illustrated embodiment is suitable for use for sampling cigarette rods from a mass flow. For such samples the probe "length" is 30 mm from the apex or narrow end 3 to the furthest point of wider base 5, and the probe 1 is 12 mm "deep" i.e. the maximum distance between divergent faces 7 and 9 is 12 mm. As noted above, the divergence is about 25°. When sampling cigarettes from a mass flow the dimensions of the probe body are chosen to suit the mass flow. With a short mass flow path with a sampler at the base of the mass flow the probe body must not be too long from apex to base as this can reduce the drive force exerted by the conveyor on the mass flow. If there is a longer mass flow path it is possible to choose a longer length (apex to base) of the probe without reduction of conveyor drive; with a longer probe the wedge angle/divergence can be less.

The probe body 1 has a passage 10 extending from end to end thereof and open at both ends; passage 10 has a first channel or bore 11 and a second, narrower, channel or bore 13, both parallel to apex 3 and base 5 of the wedge. The diameter of the first bore is more than that of the rods to be sampled. The bores 11, 13 communicate laterally through a narrow channel 15, along the full length of the bores. For use with cigarette rod samples the bore 11 is of 9 mm diameter, which is suitable for cigarette rod samples of a range of diameters.

The unitary streamlined probe 1 has a sampling portion 17 and an exit portion 19. In use, the sampling end 17 is positioned within a mass flow of rods moving parallel to their axes, with wedge apex 3 facing upstream; the probe may be placed at any height within the mass flow and at any position along its length; advantageously it is of shape and dimensions such as to cause little or no perturbation of the mass flow and can be located at or near the bottom of the flow and close to the start of the flow (see FIG. 6). The exit end is located out of and laterally adjacent to the mass flow.

The top face 7 of the probe has, at the sampling portion, a first elongate opening or sampling window 21 which communicates with the first bore 11 and is dimensioned such that a sample rod 2 can drop from the mass flow through the window 21 to rest within the first bore 11.

At the exit portion of the probe, a second elongate opening or exit window 25 is located in the bottom face and is dimensioned such that a sample rod 2 in bore 11 and in register with exit window 25 will fall through exit window 25. A receiver cartridge 47 (shown purely diagramatically in FIG. 2) may be positioned to receive such sample rods.

FIG. 3 shows a rod sampler having a probe as above plus transport means or shuttle 27 for moving a collected rod along the passage 10 of the probe. The shuttle includes a cylindrical rod 29 which fits within bore 13. It will be appreciated that the rod 29 does not have to be cylindrical, any shape being acceptable provided it can move back and forth within bore 13. The rod 29 is linked by first and second connectors 31*a*, 33*a* to first and second members (e.g. cylindrical baffles 31, 33) which are located in first bore 11; said members may be any shape provided they can move through bore 11 and member 33 can exert gentle force on a sample rod sufficient to move it. The first and second members 31, 33 are dimensioned so that they fit within bore 11 and can move along the bore 11. The connectors 31*a*, 33*a* pass through narrow channel 15. Thus, longitudinal movement of rod 29 within and along bore 13 causes equal and simultaneous longitudinal movement of first and second members 31, 33 within and along first bore 11. The first and second members 31, 33 are separated within bore 11 by a distance that is slightly larger than the length of a sample rod.

The shuttle is driven by an actuator 28 (such as, for example, a rodless piston). Actuator 28 is connected to cylindrical rod 29. The actuator 28 is located at the exit portion of the probe (i.e. out of the mass flow). The movement of the actuator 28 is exerted on the sample rod 2 by means of the shuttle 27; in this way it is not necessary for bulky drive means to be located within the sampling portion 17 of the probe. The movement of the actuator 28 is controlled by microcomputer.

First member 31, which is the closest to the exit portion of the probe body, carries a sensor 32 in the form of an optical fibre. The sensor registers the absence or presence of a sample rod 2 between first and second baffles 31, 33 within bore 11. The sensor is connected to the microcomputer. It will be appreciated that the first member 31 plays no part in actually transporting the sample, merely acting as a convenient mounting for the sensor 32. The sensor may be located elsewhere, for example in the probe body, on member 33 etc.

The rod sampler also includes a block piece 37. The block piece includes plastic slide member 39 which is slidably located within bore 11. The slide member 39 is linked to a magnetised pin 41 which extends through narrow channel 15 and bore 13 into channel 16. The slide member 39 is located in the bore 11 on the opposite side of the second baffle 33 to the exit section. Slide member 39 includes magnet 40 located on a portion closest to the exit section (and second member 33); magnet 40 is attracted to second member 33, which is, for example, steel. Slide member 39 is able to slide between first and second positions. In the first position, in which it is located further from the exit section, the slide member 39 is wholly out of register with the window 21, in magnetic contact with second member 33. In the second position the slide means is in register with window 21, thereby preventing entry of a sample rod. The slide means is retained in the second, or blocking, position by magnetic attraction between magnetic pin 41 and a steel screw 43, which is located in the channel 16 of probe 1. In this blocking position the slide member 39 will become detached or disengaged from second member 33 (remaining in the blocking position while the shuttle continues to move towards the exit portion until the shuttle returns, as discussed below).

It will be appreciated that it can be important and desirable to block the window 21 while a sample is being transported longitudinally, so as to prevent further samples entering bore 11 or becoming jammed or trapped in the window 21. The blocking slide member 39 with magnet 40 and pin 41 serves this function, but it is also possible to provide, for example, a spring which urges a slideable blocking member into blocking position: such a blocking member is displaced when shuttle 27 and member 33 thereon overcomes the spring force to push away the blocking member to open the window.

The method of operation of the embodiment shown in FIGS. 1 to 3 will now be described with reference to FIGS. 4*a* and 4*b*.

Figure 4A:
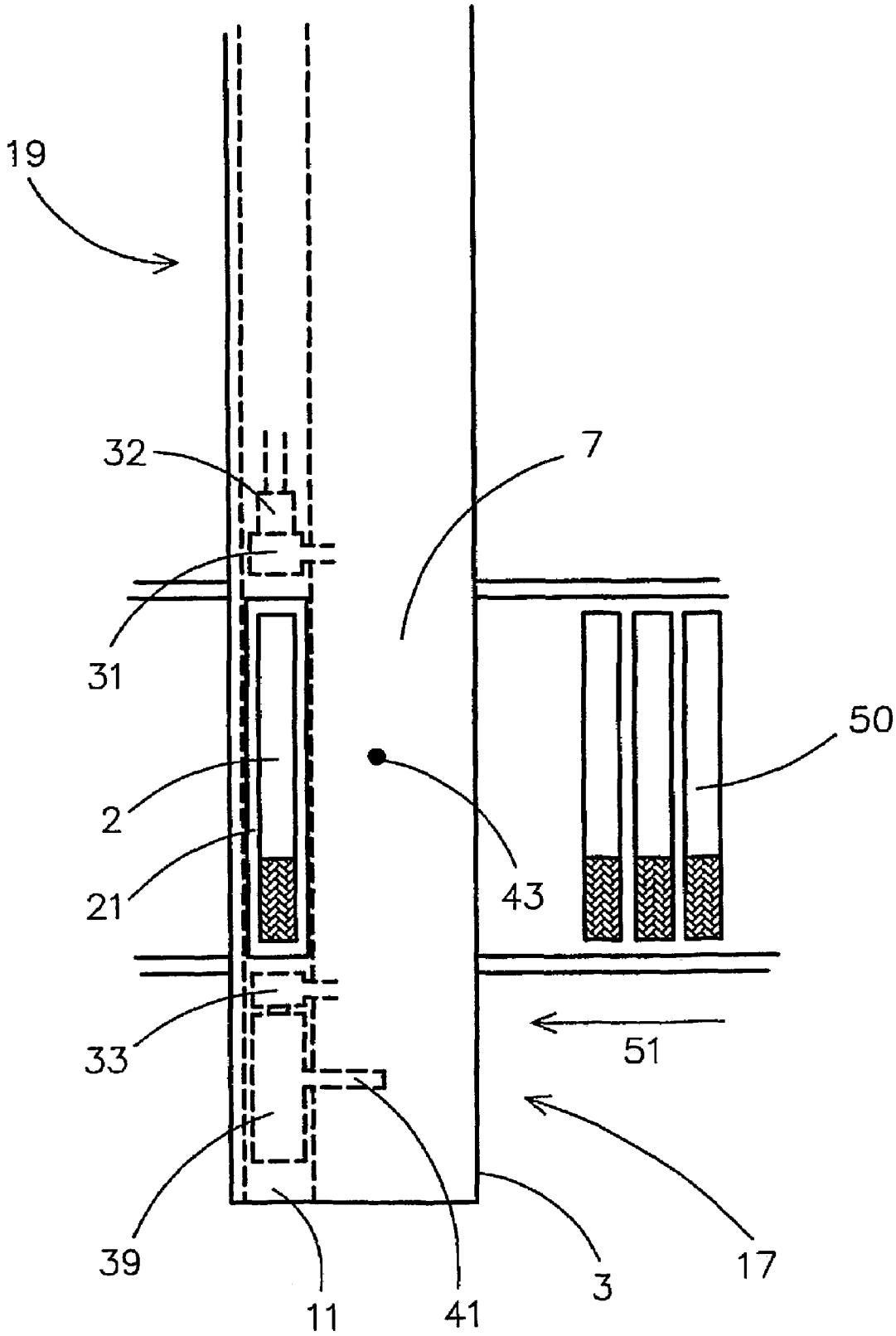
FIG. 4*a* is a top plan view of part of the rod sampler of FIG. 3 in use in a first operating configuration, showing elements (which are inside the probe) in dotted outline.
Figure 4B:
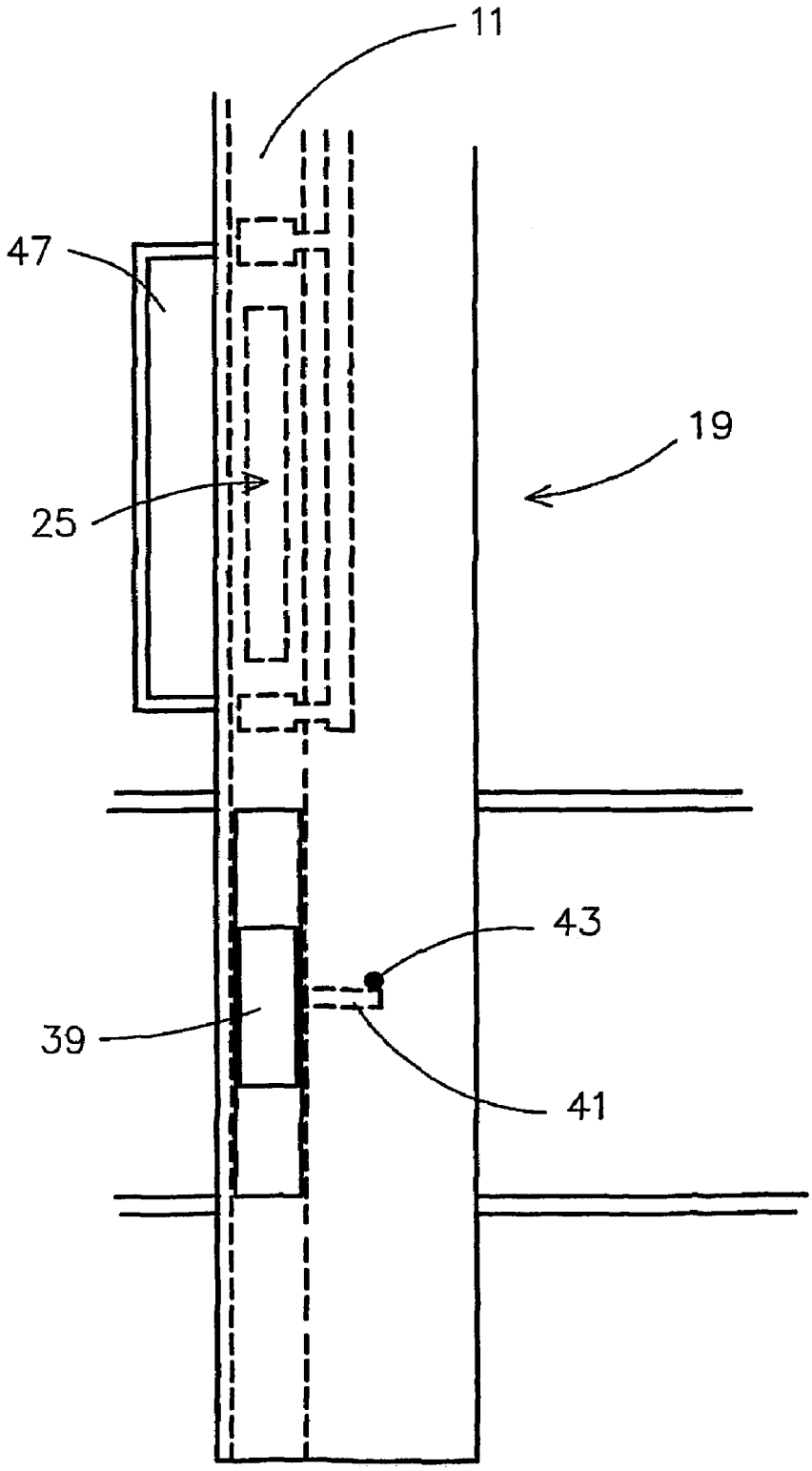
FIG. 4*b* is a view of FIG. 4*a* in a second operating configuration.

In FIG. 4*a* the probe 1 is shown fixed with the sampling portion 17 held in a mass flow of parallel rods moving perpendicular to their own axes from a manufacturing line. The direction of mass flow 50 is shown by arrow 51. The probe 1 is perpendicular to the direction of mass flow 50. The orientation of cigarettes within the mass flow 50 is the same as that of narrow end 3 of probe 1, and the probe is fixed so that the narrow end 3 faces the mass flow—i.e. the narrow end is upstream. In FIG. 4*a*, the probe body 1 is seen in the sampling position. Sampling window 21 is "open". The shuttle 27 is positioned at the sampling portion 17, and first and second members 31, 33 are located, one at either end of the window 21, i.e. bracketing the window. Until the sample enters the window, optical fibre sensor 32 shows that no sample is present.

The mass flow of rods encounters the narrow end 3 of the wedge of the probe 1; depending on the positioning of the probe 1 within the mass flow 50, most, sometimes all, of the rods flow over the top face 7 of the probe 1. If a rod 2 flowing or passing over the top face 7 comes into register with sampling window 21 the rod 2 will fall laterally through the window 21 to rest within first bore 11.

The optical fibre sensor 32 registers the presence of the sample rod 2 and activates the actuator 28, which moves towards the exit portion 19 of the probe. The actuator 28 is connected to the rod 29 of shuttle 27. Movement of the actuator 28 causes movement of the cylindrical rod 29, causing the first and second members 31, 33 to move longitudinally along the bore 11 towards the exit portion 19; the sample is pushed longitudinally away from the window 21 in the sampling portion to and into the exit portion. In addition, magnetic attraction between second member 33 and magnet 40 on slide member 39 causes the slide member to be drawn longitudinally in the direction of the exit section and thus across the window 21 thereby blocking entry of further samples. The slide member is drawn longitudinally in the direction of the exit section until magnetic pin 41 contacts steel screw 43 which is located in channel 16. The screw prevents further movement of pin 41 and slide member 39 and retains the slide member 39 in place through magnetic attraction between pin 41 and screw 43. Slide member 39 becomes disengaged from second member 33 (and shuttle 27) as second member continues to be drawn to the exit portion 19, remaining in position to block entry of further samples.

As the sample rod is moved longitudinally along bore 11 into the exit portion 19 it comes into register with exit window 25 and falls therethrough into a receiver. This may be a receiver cartridge 47, as shown in FIG. 4*b*. In an alternative, the receiver cartridge may be replaced by a sampling/testing machine inlet hopper so that the sample rod may be transferred directly into the testing machine.

The optical fibre sensor detects exit of the sample from the bore 11 and the microcomputer reverses direction of motion of the actuator 28. The shuttle 27 is moved (via the rod 29) longitudinally towards the sampling end 17 so that it returns to the original position where sample window 21 is "open"; the slide member 39 is re-engaged by the shuttle 27 and pushed away from magnetic screw by the second member to open the window. The sample window 21 is now ready to receive a further sample cigarette rod 2' from the mass flow 50.

The slide means 39 allows so called gating, i.e. the sample window is blocked by the slide means 39 or is open to receive one sample. Entry of a sample into the window blocks the window to other samples, and prevents other sample rods from being retained or trapped in the vicinity of the window. Thus sample rods can be of various diameters without causing jamming.

The embodiments have been described in general terms with reference to rod sampling and also with reference to cigarette rod sampling. It will be appreciated that the embodiments are suitable for, but not limited to, cigarettes, filter cigarettes and filter rods. The methods and apparatus described are suitable for sampling in general.

Figure 5:
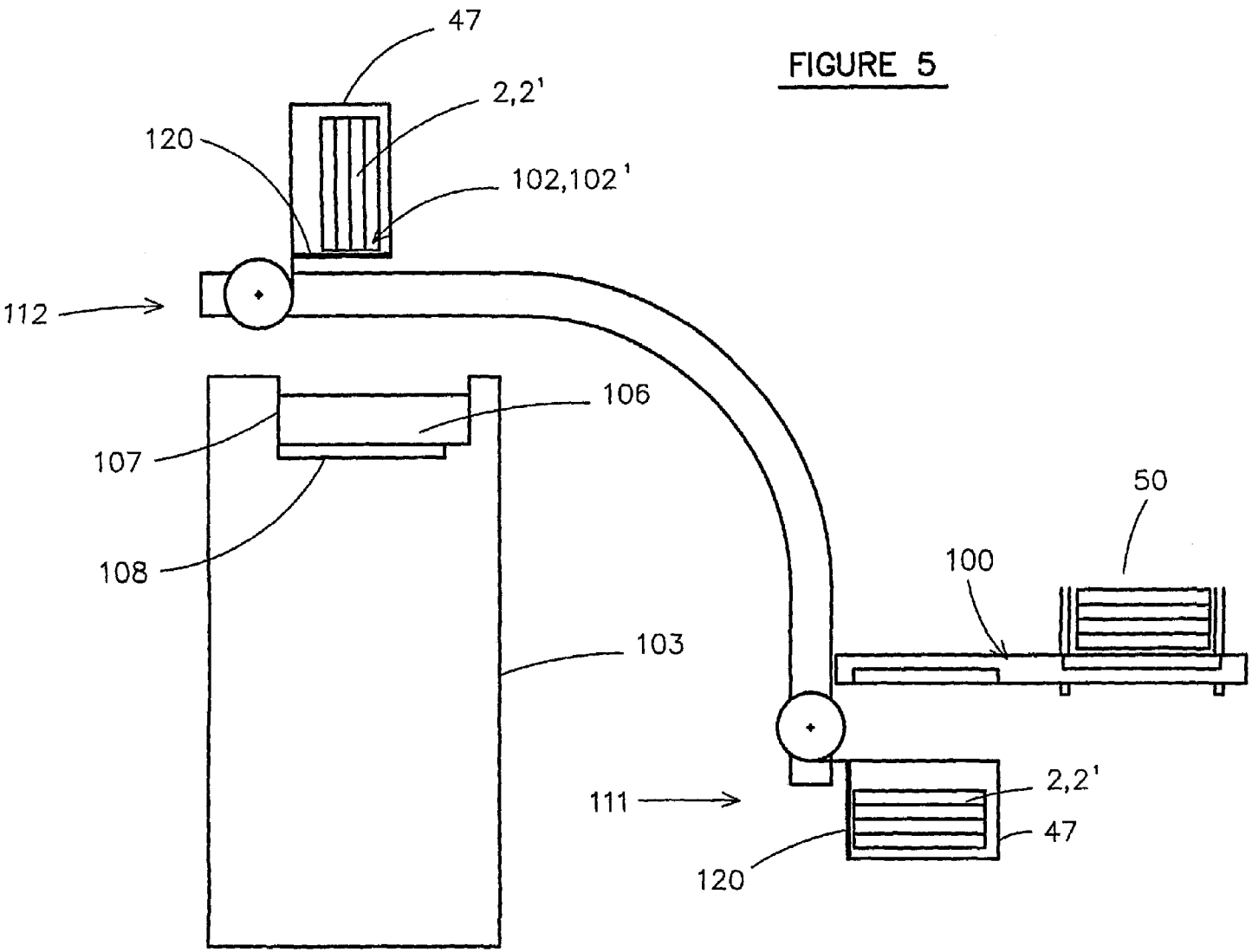
FIG. 5 is a cutaway side view of a second aspect of the invention.

In a further embodiment, as shown in FIG. 5, a receiving body including a sample probe of the type described above which provides a batch of sample rods 2, 2' from a mass flow and transports them to a testing station for testing.

In FIG. 5, reference numeral 100 denotes a probe as described and shown in FIGS. 1 to 4 above. The probe 100 functions as described above, taking sample rods 2, 2' from mass flow 50 and depositing them in cartridge 47. The whole system is microprocessor controlled, and the control system (not shown), which monitors sampling using sensor 30, operates probe 100 until the desired number of samples, for example ten, are present in the cartridge 47.

Test station 105 is remote from the probe 100 and mass flow 50. Such test stations are well known. For example, if the samples are cigarettes the test station 105 may includes a stack of various test machines for measuring pressure drop etc of the sample rods 2, 2'. The test station 105 includes inlet hopper 106. During operation of the test station sample rods 2, 2' are removed from the inlet hopper 106 through test inlet 108 one by one and tested individually. In order to avoid faults in operation (e.g. jamming of rods 2, 2' during removal from the hopper 106) the ends of sample rods 2, 2' must be aligned with a datum which is in register with test inlet 108; for this to be the case the ends 102, 102' of rods 2, 2' in the hopper are abutted against a wall of the hopper 107.

Cartridge 47 is mounted on one wall 120 to a track 110 which runs between sampler 100 and test station 105. The track may include a magnetic rodless piston system run pneumatically, such as that sold by SMC of Japan. A magnet moves up and down within the track from sampler 100 to test station 105. Cartridge 47 includes a carriage which may be engaged by the magnet. When the cartridge 47 is engaged by the magnet the cartridge 47 is transported with the magnet. Thus, the cartridge 47 may be transported along track 110 from a loading position 111 in which it is positioned under the outlet of sampler 100 (where wall 120 is vertical), to a first unloading position 112 prior to engagement with hopper 106 of test station 105. During transport, the path followed by cartridge 47 is such that the orientation of the cartridge and samples therein is changed. In loading position 111 (where wall 120 is vertical) the sample rods lie horizontally within the cartridge 47, with the ends 102, 102' closest to wall 120. In first unloading position 112 (where wall 120 is horizontal) the sample rods lie vertically within the cartridge 47, with the ends 102, 102' held by gravity so that they abut onto i.e. are in register with the datum point of wall 120.

Thus the control system is able to register when the desired number of samples 2, 2' is present in the cartridge 47 and transport these to the test station for unloading.

Figure 5B:
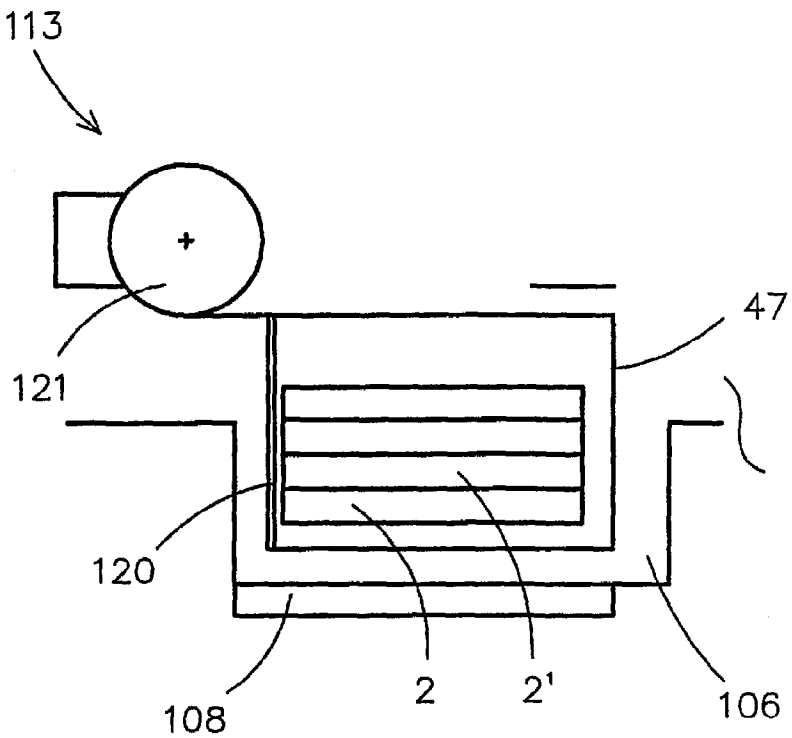
FIGS. 5*a* and 5*b* show elements of FIG. 5 in different operating configurations.
Figure 5A:
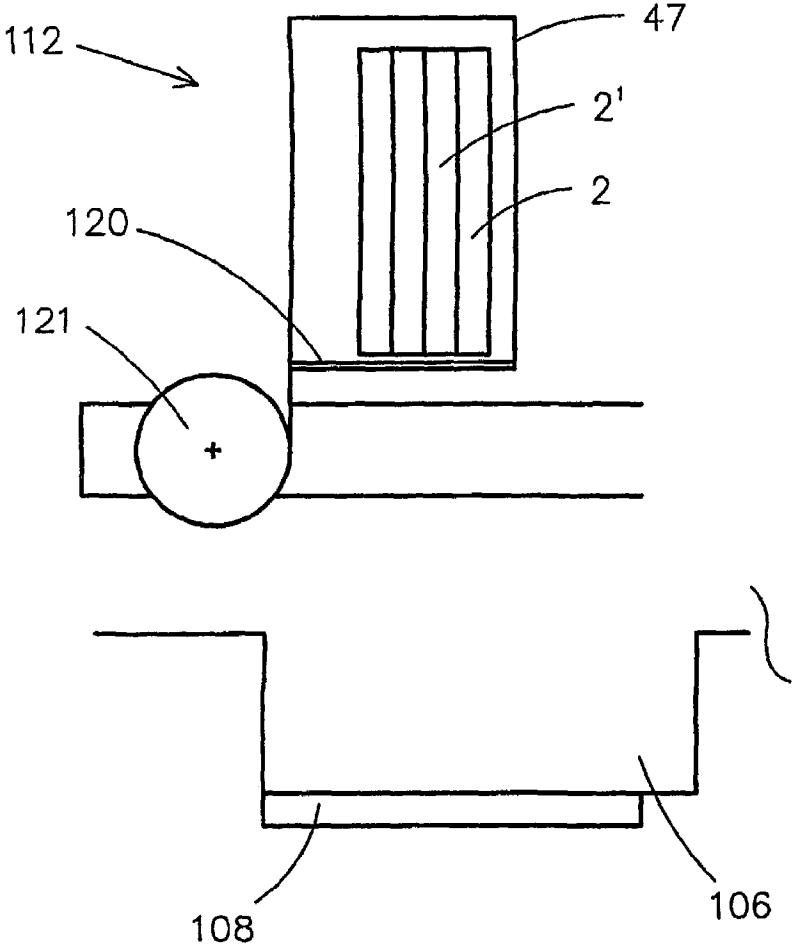

The unloading of cartridge 47 may be more readily understood with reference to FIGS. 5*a* and 5*b*, which show detail of FIG. 5. In FIG. 5*a*, the cartridge 47 is shown in first unloading position 112 described above. One end of wall 120 engages with hinge 121.

In FIG. 5*b*, the cartridge 47 is shown in second unloading position 113. The cartridge has been swung around hinge 121 so that wall 120 is vertical (and sample rods 2, 2' are horizontal); the cartridge is in the same orientation as in loading position 111. The swing between positions 112 and 113 is effected slowly so that the sample rods 2, 2' are not disturbed in cartridge 47; they are maintained in register with wall 120.

In second unloading position 113 the wall 120 of cartridge 47 is aligned with wall of the hopper 107; the butt ends 102, 102' ends of sample rods 2, 2' (which are in register with wall 120) are in register with inlet 108. The cartridge 47 is opened and the samples may be readily taken into hopper 106 and from there to inlet 108.

It will be appreciated by the skilled man that the hopper 47 requires removable releasable closure means in order to retain samples 2, 2' within the container during transport/reorientation while enabling loading/unloading of the samples 2, 2'. These are conventional and well known not been included in order to simplify description.

Figure 6:
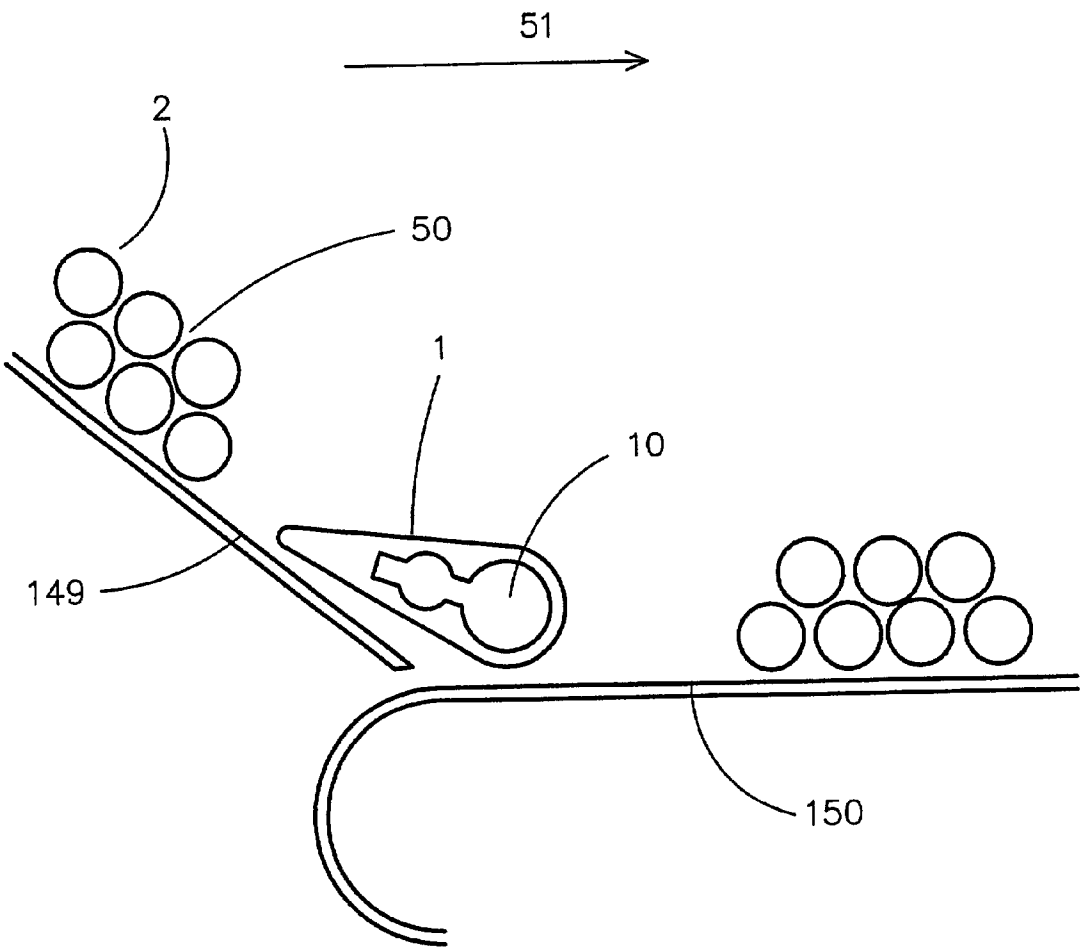
FIG. 6 shows a cutaway side view of mass flow and probe illustrating another aspect of the invention.

FIG. 6 shows a further aspect of the invention. A sampler probe 1 is in position in a mass flow 50 of samples 2 moving in direction 51. The mass flow moves down exit ramp 149 of a production machine (the machine is not shown) and is moved on by conveyor 150. The probe 1 is located at the base of the mass flow in the region of the link between ramp 149 and conveyor 150.

In FIG. 4*a* the rods 2 from mass flow 50 are shown as filter cigarettes oriented with the filter portions away from exit portion 19 of the sampler. The filter cigarettes could be in the reverse orientation, with filter ends towards exit portion, the orientation chosen depending on that required for the rods in subsequent operations. Equally the filter cigarettes could be replaced by other types of rod—e.g. untipped cigarettes, filter rods or rods entirely different from these and unrelated to smoking articles. Accordingly, in the other Figs. the rods are shown without indication of structure, composition or orientation.

While the invention has been described in detail and with reference to specific examples thereof, it will be apparent to one skilled in the art that various changes and modifications can be made therein without departing from the spirit, and scope thereof.

What is claimed is:

1. A probe for use in sampling rods from a mass flow of parallel rods moving perpendicular to axes of the rods, the probe comprising:

an elongate body of generally wedge shaped cross section having first and second main faces diverging away from a narrow edge to a wider base and being adapted for mounting parallel to the rods to extend across and laterally beyond said mass flow with the narrow edge facing upstream; an elongate passage extending within said body longitudinally thereof for accommodating a rod from the mass flow; a first elongate opening in the first face through which a rod from the mass flow can fall laterally into said passage for longitudinal transport along said passage away from the mass flow; and a second elongate opening through which a rod can drop laterally from said passage out of said body after the longitudinal transport.

2. A probe according to claim 1 wherein said narrow edge is rounded.

3. A probe according to claim 1 wherein said base is rounded.

4. A probe according to claim 1 wherein the elongate passage runs from end to end of the body and is open at both ends.

5. A probe according to claim 1 wherein at least the first elongate opening has no closure means forming part of the probe per se.

6. A probe according to claim 5 wherein both first and second elongate openings have no closure means forming part of the probe per se.

7. A probe according to claim 1 having no moving parts.

8. A probe according to claim 1 wherein the body is a unitary cast or extrusion.

9. A probe according to claim 1 wherein the first and second elongate windows do not overlap longitudinally.

10. A probe according to claim 1 wherein the elongate passage comprises a first channel shaped to retain the rod accommodated therein without substantial lateral movement.

11. A probe according to claim 10 wherein the elongate passage includes a second channel parallel to the first.

12. A probe according to claim 11 wherein the first and second channels are in lateral communication.

13. A rod sampler comprising a probe according to claim 1 and means for transporting a sample rod accommodated in the passage longitudinally therealong for exit from the probe through said second elongate opening.

14. A rod sampler according to claim 13 wherein the means for transporting the sample rod includes a member moveable to abut one end of the sample rod to move the sample rod gently through the passage.

15. A rod sampler according to claim 14 wherein the elongate passage of the probe comprises a first channel shaped to retain the rod accommodated therein without substantial lateral movement and a second channel parallel to the first channel and in lateral communication with the first channel, and said transport member is in said first channel and mounted on a rod or wire extending through said second channel, means being provided for moving said rod or wire longitudinally.

16. A rod sampler according to claim 13 including at least one blocking member adapted to move longitudinally in the passage to a position under the first elongate opening when the transport means is operated to convey the rod and is adapted to move back when the transport means returns to receive a second rod.

17. A rod sampler according to claim 16 including means for decoupling the blocking means from the transport means when the blocking means is in position under the first elongate opening to thereby retain the rod in a blocking position and means for recoupling the blocking means to the transport means when the transport means returns to receive a second rod.

18. A rod sampler according to claim 13 including sensing means for sensing the presence and/or absence of a sample rod within the elongate passage.

19. A rod sampler according to claim 18 wherein the sensing means is located on a member adapted to move simultaneously with the transport member.

20. A method of sampling rods for testing from a mass flow of parallel rods moving perpendicular to their axes, the method comprising collecting an individual rod in an elongate sampler probe extending parallel to the rods across and beyond the mass flow, conveying the collected rod longitudinally through the probe to a position adjacent to the mass flow and there delivering the conveyed rod directly to a test site, and repeating such collection, conveying and delivery, said collection, conveying and delivery being conducted without application of pneumatic pressure directly onto said rods and substantially without impact on said rods wherein the sampler probe is a probe according to claim 1.

21. A rod handling apparatus comprising a conveyor for carrying a mass flow of parallel rods perpendicular to axes of the rods, a ramp down which the rods are fed perpendicular to the axes to the conveyor, an elongate sampling probe extending across the flow path and having in an upper face thereof an elongate opening for the collection in the probe of a rod from the mass flow, and means for transporting the collected rod longitudinally trough the probe away from the mass flow, the probe being positioned at or adjacent to the ramp and being of generally wedge shape wit a wedge apex facing upstream whereby the probe causes little disturbance to the mass flow wherein the sampling probe is a probe according to claim 1.

22. Apparatus for sampling rods from a mass flow of the rods perpendicular to axes of the rods, the apparatus comprising a probe according to claim 1 adapted to extend across the mass flow parallel to the rod axes, the probe having a passage extending longitudinally thereof for transport of a sampled rod and an elongate window through which a sample rod can pass train the mass flow into said passage, means operable to transport a rod received through said window longitudinally through said passage away from said window to an exit and to reset the apparatus for receipt of another rod from the mass flow through the window into the passage, and blocking means which simultaneously with said transport moves along the passage into registration with the window and remains in such registration until said resetting.

23. Apparatus according to claim 22 wherein said transport and reset means moves along the passage to transport the sample rod to the exit and draw the blocking means into registration with the window, and returns to push the blocking means clear of the window for receipt of another rod from the mass flow.

24. Apparatus according to claim 23 wherein the transport means and reset means can disengage from the blocking means after drawing the blocking means into register with the window and re-engage therewith when the transport means and reset means returns to push the blocking means clear of the window.

25. Apparatus according to claim 22 wherein the presence of a sample rod and/or blocking means in the passage in register with the window prevents the ingress of a further rod through the window into the passage and the jamming of the rod in the window.

26. Rod handling apparatus comprising a conveyor for carrying a mass flow of parallel rods perpendicular to axes of the rods, a ramp down which the rods are fed perpendicular to the axes to the conveyor, an elongate sampling probe extending across the flow path and having in an upper face thereof an elongate opening for the collection in the probe of a rod from the mass flow, and means for transporting the collected rod longitudinally through the probe away from the mass flow, the probe being positioned at or adjacent to the ramp and being of generally wedge shape with a wedge apex facing upstream whereby the probe causes little disturbance to the mass flow.

27. A rod handling apparatus according to claim 26 wherein the elongate sampling probe is located at or near a base of the mass flow.

* * * * *